United States Patent [19]

Longinotti

[11] 4,153,401

[45] May 8, 1979

[54] EQUIPMENT FOR FILLING MOLDS WITH COLORED MORTARS AND WITH THE AID OF PARTITIONS TO DEFINE PATTERNS ON THE VISIBLE SURFACE

[76] Inventor: Enrico Longinotti, Via Timoteo Bertelli, 2, Firenze, Italy, I-50133

[21] Appl. No.: 867,351

[22] Filed: Jan. 5, 1978

[30] Foreign Application Priority Data

Jan. 7, 1977 [IT] Italy ..... 9304 A/77

[51] Int. Cl.[2] ..... B28B 13/02

[52] U.S. Cl. ..... 425/134; 425/130; 425/147; 425/215; 425/227; 425/257; 425/448

[58] Field of Search ..... 222/160, 162, 319; 425/130, 147, 183, 215, 227, 256, 257, 448, 134

[56] References Cited

U.S. PATENT DOCUMENTS

| | | | |
|---|---|---|---|
| 720,588 | 2/1903 | Huss | 222/162 |
| 1,548,474 | 8/1925 | Miller | 425/227 |
| 2,007,961 | 7/1935 | Bolton | 425/130 |
| 2,167,690 | 8/1939 | Serinis | 222/319 |
| 3,271,817 | 9/1966 | Kanbar | 425/147 |
| 3,296,675 | 1/1967 | Filangeri | 425/130 |

FOREIGN PATENT DOCUMENTS

| | | | |
|---|---|---|---|
| 1101829 | 1/1968 | United Kingdom | 222/629 |

*Primary Examiner*—Roy Lake
*Assistant Examiner*—John McQuade
*Attorney, Agent, or Firm*—McGlew and Tuttle

[57] ABSTRACT

Equipment for filling molds with colored mortars to obtain cement tiles or the like, having a pattern, includes a filling station having a pair of mold partitions which can be raised and lowered with respect to the molds and which can be rotated horizontally through 180° between a first position, in which a partitioned unit is aligned with a mold, which may be a multiple mold, to be filled, and a second position in which a mold unit is in an outer washing position. A batching unit is raisable and lowerable on the mold, and includes several small tanks for the colored mortars, discharge tubes emerging from the bottoms of the tanks, and batching cups that can slide in a sealed manner along the tubes and which are moved along the tubes between a position submerged in the mortar of the small tanks and a raised and emergent position, in which the mortar contained therein is discharged into the respective tube.

7 Claims, 6 Drawing Figures

EQUIPMENT FOR FILLING MOLDS WITH COLORED MORTARS AND WITH THE AID OF PARTITIONS TO DEFINE PATTERNS ON THE VISIBLE SURFACE

FIELD AND BACKGROUND OF THE INVENTION

The invention relates to an equipment for filling molds with colored mortars and with the aid of mold partition unit, to obtain cement tiles or the like, having a pattern, which equipment is to be combined with machines for the manufacture of cement tiles of the like.

The equipment has been designed to solve the problem of batching for the applications mentioned.

Known batching plants, of the semi-automatic type, provide for a sequence in filling the several compartments formed by partitions, which permits leakages of color from one compartment being filled towards one or more adjacent compartments which are empty. The batching is entrusted to the visual faculty of the operator and thus is often variable, and involves the use of two or more operators (one for each color) and practically allows only a restricted number of colors, mostly two, unless provision is made for an increase of the number of the batching units, thus increasing the cited drawbacks.

Usually seven partitions have been used, not all strictly similar and subjected to a remarkable wear.

SUMMARY OF THE INVENTION

Contrary to the previous systems, the batching or metering unit according to the invention (initially provided for at least three colors, has the following features:

it is fully automatic and thus requires only the use of watching personnel;

all the colors are simultaneously introduced, in such a manner as to avoid leakages between adjacent compartments;

only two sets of partitions are used (one in the working stage and one in the washing stage);

a higher speed is obtained (up to 3.5 pressing operations/minute), as all movements are automated.

The batching unit according to the invention includes, in the filling station, two partition units that can be raised and lowered with respect to the mold and moved horizontally in order to locate a partition unit in correspondence with a mole, which may be a multiple mole, to be filled, and an outer washing position, a batching unit raisable and lowerable on the mold, involving several small tanks for the colored mortars, which are therein supplied and kept under stirring, respective discharge tubes emerging from the bottoms of the tanks, and respective batching cups that can slide in a sealed manner along these tubes and are moved, by an equipment carrying them along the tubes, between a position submerged in the mortar of the small tanks and a raised and emergent position, in which latter position the mortar contained therein is discharged into the respective tubes.

The small tanks equipment further may be moved with a cyclical motion to form a stirrer for the mortar contained in the tanks.

A first cylinder-piston system may be provided to lower the assembly of the small tanks and the cups as a unit onto the partition unit previously lowered into the mold to be filled. A second cylinder-piston system, combined and coaxial with the first one, may be provided to operate the cups, and between the second cylinder-piston system and the cups a connecting rod and crank stirring system may be interposed, which cyclically moves the batching cups along the discharge tubes, causing the stirring of the mortars.

A tray made up of several notchable sections is advantageously provided for insertion between the partition unit and the batching unit, in order to avoid an accidental fall of material into the filled mold after the filling.

In the washing position of the partition unit, there are advantageously provided a rotary spraying unit in a collecting cup, onto which the partition assembly or unit being washed is moved and into which it is lowered, and a covering plate which is lowered onto the partition and onto the cup, as a protection against splashes. The covering plate may be carried by the same raisable and lowerable batching unit.

BRIEF DESCRIPTION OF THE DRAWINGS

The invention will be better understood from the following specification and the accompanying drawing which illustrates a practical embodiment which does not limit the invention.

In the drawing.

DESCRIPTION OF THE PREFERRED EMBODIMENT

Figure 1:
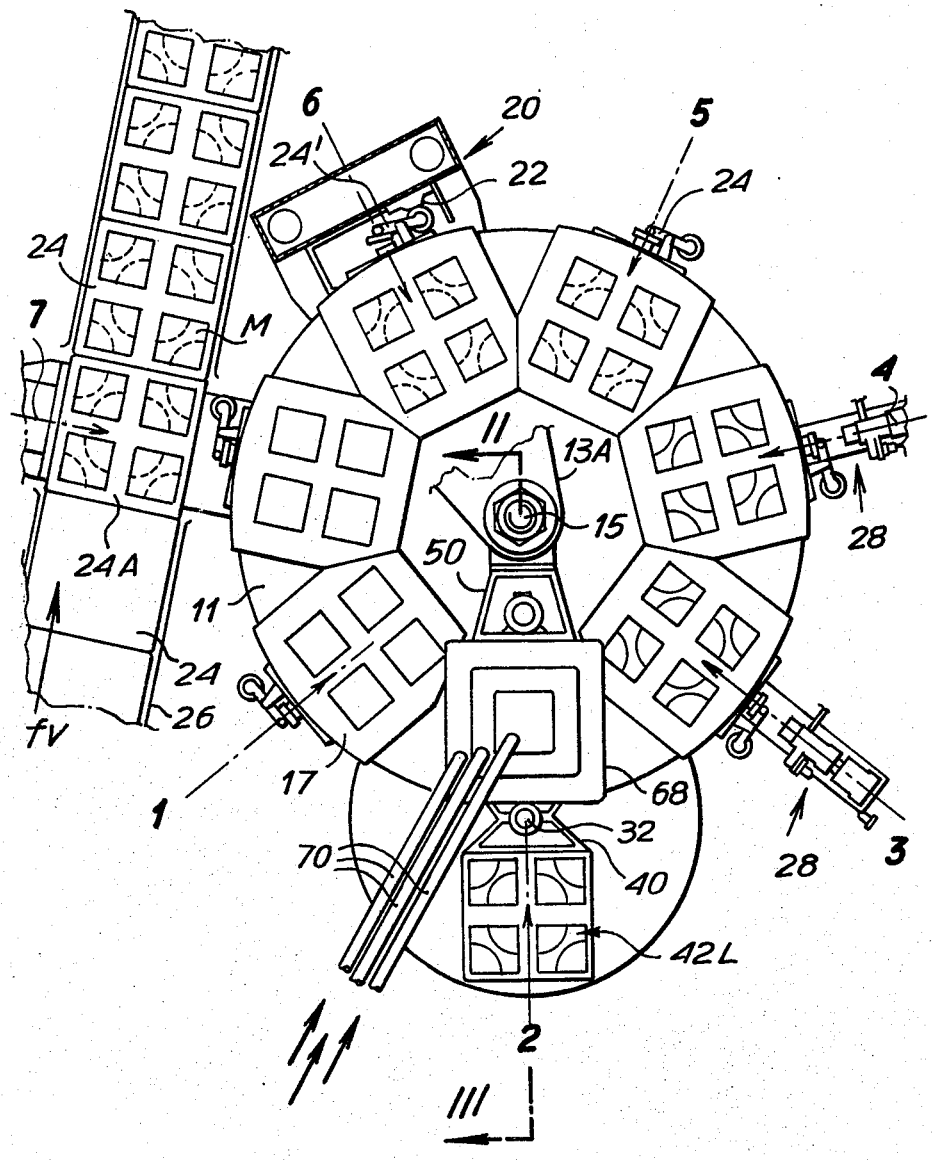
FIG. 1 illustrates an overall plan view of the equipment.

Referring to the accompanying drawing, 11 denotes a table that is a platform rotating with respect to a stationary base 13, platform 11 being assembled to rotate about a column 15 borne by the structure 13 and by an overlying centering structure 13A. The rotating platform or table 11 is provided with a plurality of multiple molds, according to the embodiment seven molds, the frames of which are denoted by 17, with a suitable number of molding cavities varying according to the sizes of the single tiles. Around the table or rotary platform 11 there are provided working or dwell stations denoted by 1, 2, 3, 4, 5, 6, and 7, at each of which during the intermittent rotation of platform 11, each of the table's molds is subsequently located. Station 1 is a die cleaning station for removing debris which may be piled up in the previous stations, and in this station it may be made possible to replace the filters for dehydration of the fluid material charged in the mold and extracted from the porous bottom of the mold, made up by the filter itself. Station 2 is designed for the batched or metered loading of the colored mortars, with the hereinafter described equipment. Also an automatic washing operation occurs in this station to wash the then inactive partition groups of two groups of partitions provided in station 2. Stations 3 and 4 are designed for the dehydration by drainage and vacuum to remove water excess from the mortars loaded in station 2. Station 5 is designed for the loading of a second relatively drier layer and, if necessary, for an additional stage of drainage by vacuum. Station 6 is a pressing station which operates with a press generally denoted by 20, which is a per se known type and not illustrated, the press being combined with the upper structure 13A to form a bridge therewith. In correspondence with this station, provisions may be made to discharge the water obtained from the drainage through a cam or profile 22 which opens a discharge valve 24 for the water collected by the drainage. Station 7 is designed for stripping the trays, with an advantageously superimposed system in order to obtain, on each tray placed under the frames, a stripping of the tiles in several layers, in such a manner as to obtain a restriction of the number of trays and a restriction of the volumes in the ageing zone. 24 generally denotes the trays which are fed, in the direction of the arrow $f_v$, along a track 26, in order to reach a position 24A at which each tray is moved—by means of a per se known equipment—under a frame 17 which reaches the station 7, for picking up one or more layers of tiles, to then return in alignment on the track 26 to be additionally advanced according to the arrow $f_v$ with the load of tiles M deposited on the same trays.

In stations 3 and 4, 28 denotes equipments designed to determine the intake, that is the vacuum under the mold, with an arrangement better described in another previous patent. An additional equipment 28 may also be provided in the station 5.

Figure 2:
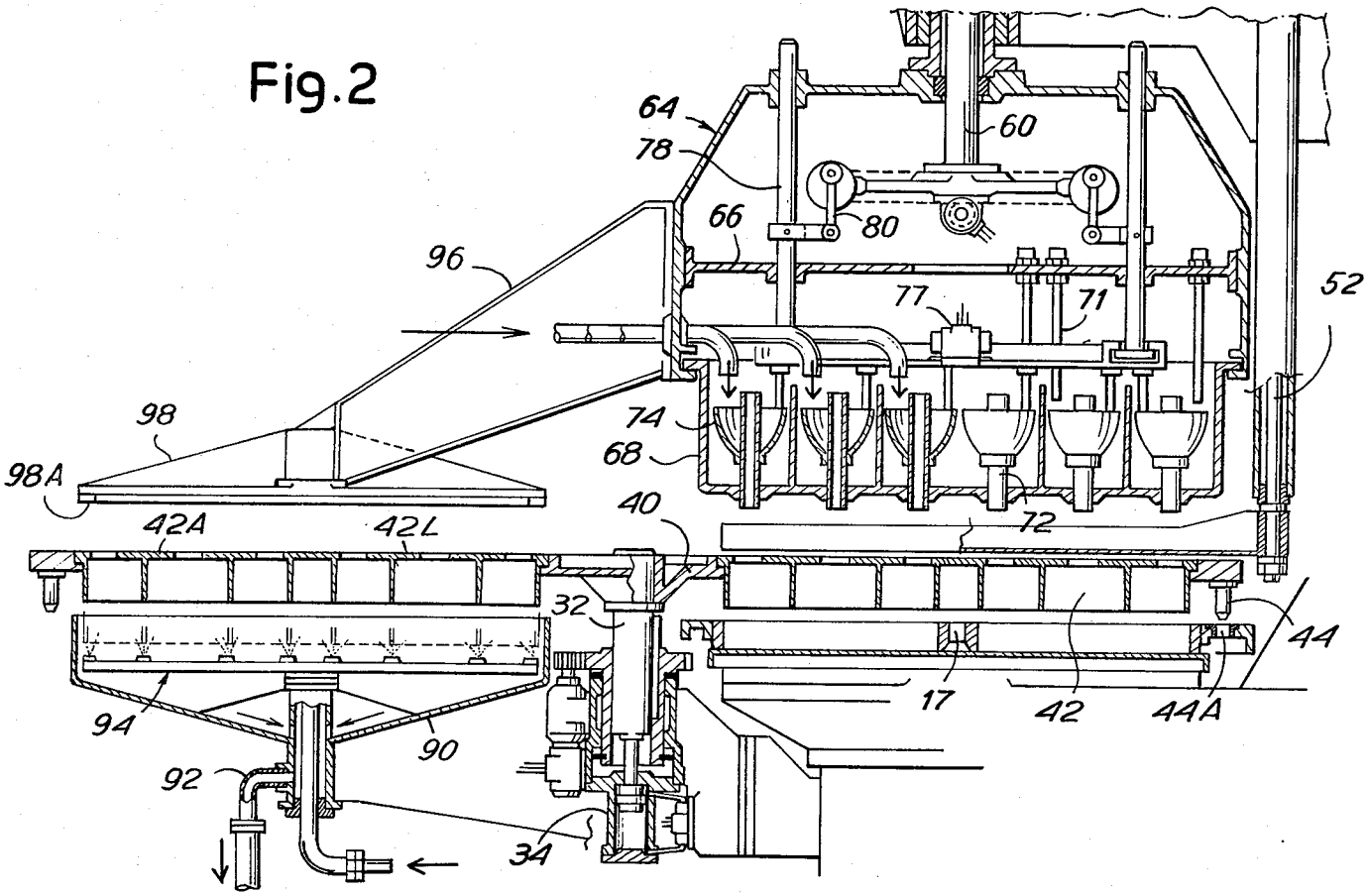
FIG. 2 is a partial vertical section of the equipment taken along the line II-III of FIG. 1.

As already stated, in station 2 it is provided to load the mortar by an equipment which is better illustrated in FIG. 2 and the following figures.

Figure 3:
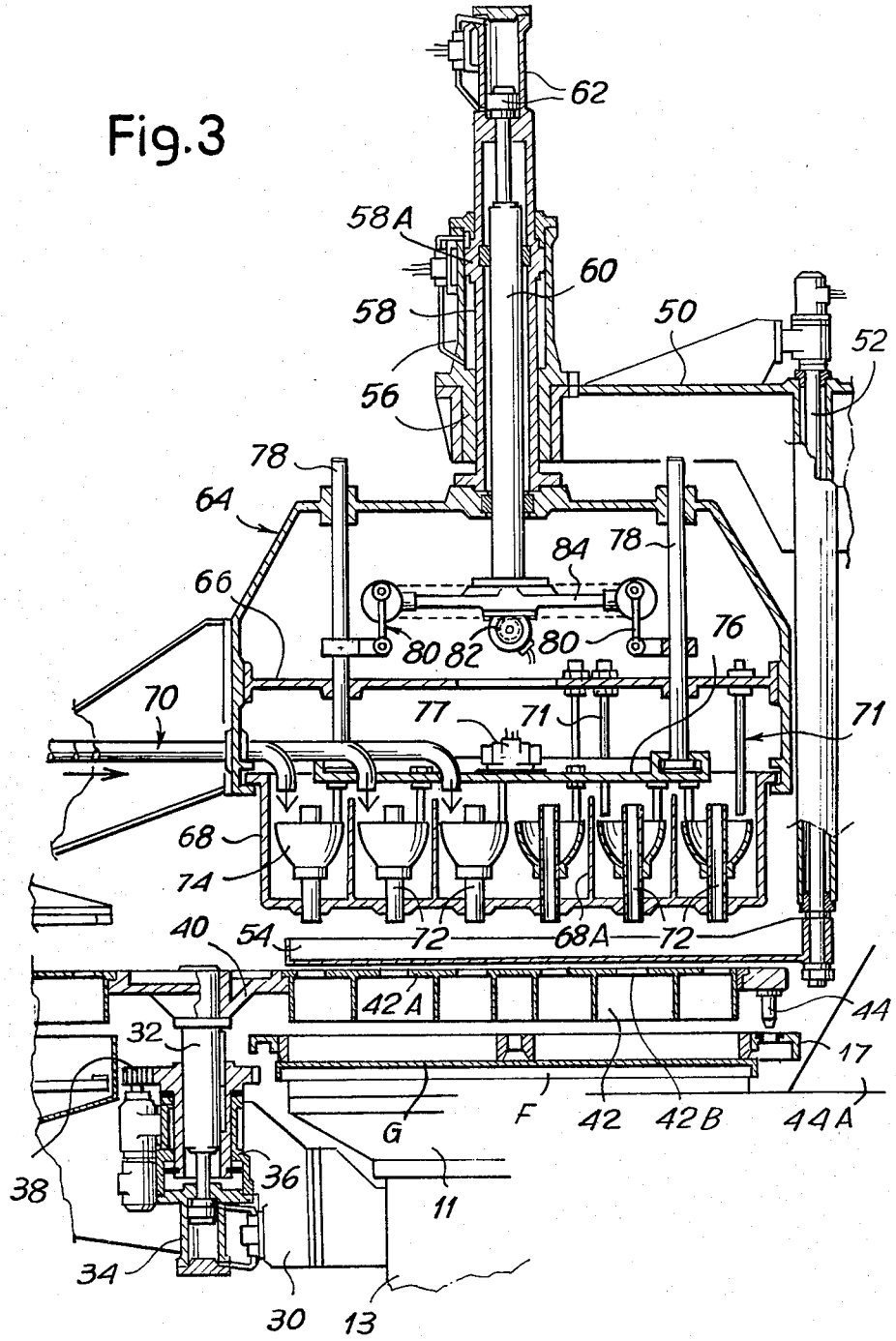
FIG. 3 is a view similar to FIG. 2 with a portion of the showing being on an enlarged scale.

Referring to FIGS. 2 and 3 on the side of the position reached by the frames 17 in the loading station 2, an arm 30 is provided which forms a rotation and axial sliding seat for a vertical shaft 32. This shaft can be raised and lowered by means of a cylinder-piston control system 34 arranged to act on the lower piston-developed end of shaft 32. Shaft 32 is additionally coupled, in a rotary manner but slidably, with a sleeve 36, which has a gear rim meshing with a pinion 38 operated by a motor. This motor is arranged to effect intermittent rotations of sleeve 36 and thus of shaft 32 and of those parts that this latter supports, for intervals or pitches of 180°. On the shaft 32 a frame 40 is provided, which forms a raisable and lowerable unit, also movable into two positions. This unit carries two partition units or assemblies generally denoted by 42, which, in one position, can be lowered into the interior of the cavity of the molds defined among the frames 17, and, in the other position, can be washed. The partition units in the washing position are denoted by 42L. For centering the partitions 42 which are to be lowered into the interior of the mold cavities, there is provided a system of plugs on the units 42 and seats in the frames 17, denoted by 44 and 44A, respectively. The partition units 42 have an upper wall 42A, in which holes 42B are formed corresponding to the points in which it is appropriate to feed the mortar, these holes, and thus these feed points, being uniformly distributed according to the distribution of the mortar and to the pattern to be obtained. The partition units are made with sheets that can be laid on the rubber layer G of the mold bottom F which is placed in each position in which a mold is located on the table 11.

At the station 2, above the mold which is to be loaded with the mortars and wherein a partition unit 42 has to penetrate, there is a batching and delivery unit of the mortar. This unit is borne by an arm 50, which extends from the stationary structure. This arm 50 includes a seat for the shaft or for a pair of shafts 52 operable to effect movement of a tray 54 in two sections, designed to be inserted under the batching structure, in order to avoid the fall of particles during some of the stages of a filling and movement cycle of the machine members. On arm 50, there is furthermore arranged a vertical sliding seat consisting of a member 56 forming a cylinder for a piston member 58A of a sleeve 58, which can slide vertically to effect lowering and raising of the batching unit. In the interior of the sleeve member 58, a column 60 is slidable and is operated by a cylinder-piston system 62 operable to effect the raising of batching cup members hereinafter described. The member 58 is a unit with a case 64, provided with an intermediate weir or partition 66 and capable of receiving, at its lower edge in a replaceable manner, a small case 68. The latter internally has a plurality of weirs or partitions 68A, designed to define a number of small tanks storing the mortars and which are to be respective to the single zones into which the cavity of the mold is divided by the partitions 42. For each type of mortar, one or more small tanks can be provided according to the distribution determined by the pattern on the distribution means, also taking account of the number of cavities and thus of the number of tiles to be simultaneously molded. In correspondence with each of the small tanks there is provided at least a mortar feeder, through conduits which are generally denoted by 70 and which are at least partly flexible, and which are fed with the respective mortars by means of pumps, independently of each other and each controlled by a suitable probe, such as those denoted by 71. The probes serve to assure always the restoration of a given level which is almost constant within given limits of tolerance, in the small tanks contained in the case 68. In correspondence with each of the holes 42B of the horizontal wall 42A of the partition units 42, and thus in correspondence with each of the delivery points, small tubes 72 extend upwardly from the bottom of the case 68 in the small tanks formed in case 68, up to above the maximum level that can be reached in the respective small tanks. Tubes 72 pass through and project slightly downwards to fit with their lower end into the holes 42B when the unit 68, 64, 58 is lowered by operation of the system 58A, 62. Around each of the tubes 72, a respectively batching cup 74 is engaged slidably and substantially tightly. The cups 74 have a volume, that is a capacity (around the respective small tube) which corresponds to the dose which is to be discharged each time by the respective tube 72. The cups 74 may thus be similar to or different from one another according to the dose which, in each point of the mold, is to be charged in the section correspondingly defined by the partitions 42. The assembly of the cups 74 is made integral with a plate 76. The plate 76, which carries the cups assembly appropriately connected thereto by means of columns adjustable by screws or the like, is movable with respect to the member 64, plate 76 being assembled on sliding ways 78 accomodated in the plate 76 and in the casing member 64. The assembly 74, 76 can be operated so as to be raised and lowered with respect to the unit 64, 68 by means of the cylinder-piston system 62, which, through the column 60, engages the guide columns 78. The connection between the column 60 and the columns 78 can be obtained through cyclical movement means of the unit 76, 78 and thus of the cups 74, obtained for instance, with crank and connecting rod systems 80, operable by a motor 82 located on the structure 84, integral with the lower end of the column 60. With these systems 80, 82, when the cups 74 are lowered and sunk into the mortars contained in the small tanks, one obtains a stirring of these mortars to avoid the decantation of the suspended contents of the mortars and prevent hardening of the cement. This cyclical stirring motion of the cups inside the masses of mortar takes place while the cups are lowered, that is, when the unit is placed under the conditions shown in FIGS. 2 and 3.

Figure 4:
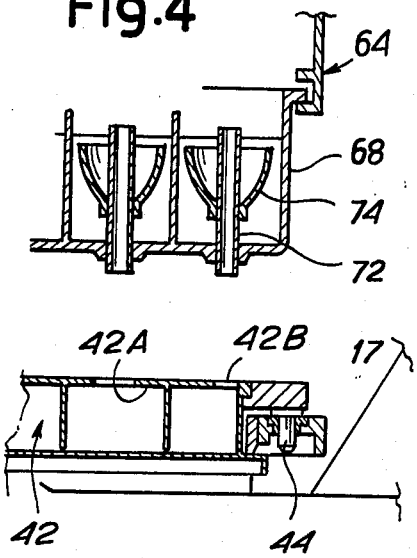
FIGS. 4, 5 and 6 illustrate details of FIGS. 2 and 3 in different arrangements of the members during a work cycle.
Figure 5:
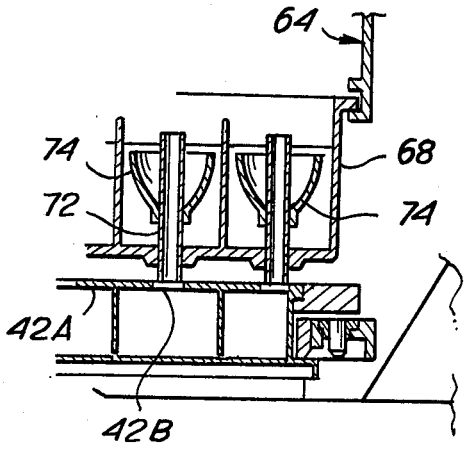
Figure 6:
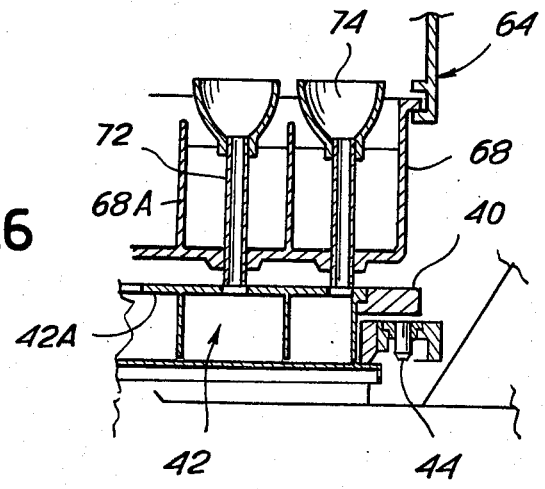

Under the conditions of FIGS. 2 and 3, the batching unit 64, 68 is raised, and the partition unit 42 is raised. When the mold to be filled has reached station 2, the control system 34 lowers the partition unit bringing the unit into the position of FIG. 4, while the tray 54, which may consist of two portions appropriately operable and in opposite directions, may be moved away. It is to be noted that until now, notwithstanding the stirring determined by cups 74, the level of the mortars in the small tanks of the case 68 is such whereby the upper ends of the tubes 72 are at least above the level of the mortars and thus the delivery of the mortars through the tubes is impossible. From the position of FIG. 4, the members are brought into the position of FIG. 5 owing to the lowering effected by the cylinder-piston system 58A, 56 on the whole unit 64, 68. Under these conditions, the tubes 72 enter into the holes 42A, or at least have their lower ends aligned with these holes. Simultaneously or immediately after the lowering of the unit 64, 68, also the raising of the cups 74 takes place with respect to the unit 64, 68, by means of the control 62 and at this time the effect of the stirring, owing to the interruption of the control by the motor 82, has ceased. Thus the position of FIG. 6 has been achieved, wherein the cups 74, sliding upwardly along the tubes 72 reach, with their upper edges the level of the mortars in the small tanks of the case 68 and thus raise, while restricting it, a dosed or batched amount of mortar which corresponds to the capacity of the single cups, less the space occupied by the associated tube. With continued relative raising of the cups 74, the mortar contained therein is discharged in the corresponding tube 72 and the amount of discharged mortar can be the total quantity of mortar contained and raised by cups 74, if these latter are raised until their bottoms are at the upper ends of the tubes, or it can be a smaller amount as a function also of the cups raising stroke. In either case, desired and established doses of mortar are delivered from each tube 72 and are discharged into the respective sections into which the cavities of the mold are divided by the sheets of the partition units 42. Immediately after the cups are relowered along the tubes 72, the assembly 64, 68 is reraised, the trays 54 may be inserted again under the batching units and the assembly of the partition units 42 is raised to allow, on one hand, the movement of the table 11 and thus the replacement of the filled mold by a mold still to be filled, and, on the other hand, the rotation of the unit 40 to bring the partitions withdrawn from a loaded mold to the washing zone 42L, while the washed partitions are located above the new mold to be filled in order to repeat the operation.

In the washing zone reached by the partitions in the position 42L, there is a cup or sump 90 having a discharge tube 92, and provided in its interior with a spraying unit 94, which is assembled in a rotating manner with nozzles appropriately directed upwardly with suitable inclinations, both to ensure the washing and to obtain a spontaneous rotational thrust by a pressurized water feed. When the unit 40 is lowered by the system 34, with the partitions in the position 42L, the frame 40 of the partitions lies on the edge of the washing cup 90, and when the unit 64, 68 is lowered, also a plate 98 is lowered by means of arm 96 plate 98, with its own packing 98A, resting on the periphery of the partition wall 42A in the position 42L. Thus a washing cavity is defined and this cavity is formed by the cup 90, by the frame of the unit 40 and by the plate 98, to carry out the washing without any dispersion of washing water.

In order to facilitate the discharge of the mortars from the metering cups 74 into the tubes 72, a vibrator 77 can be provided on the plate 76, this vibrator intervening when the discharge of the mortars must take place from the metering cups 74 into the tubes 72, thus aiding the flow of the mortars into the mold cavities. The vibration however does not affect the mold in the loading stage, to avoid possible mixtures of a mortar with the adjacent ones, both during the lowering and the raising of the partitions 42. On the other hand, upon the first dehydration which is already obtained in station 3, the mortars are stabilized and a mutual invasion of the mortars of one zone into those of a contiguous zone, is prevented, whereby a very sharp pattern results.

While a specific embodiment of the invention has been shown and described in detail to illustrate the application of the principles of the invention, it will be understood that the invention may be embodied otherwise without departing from such principles.

I claim:

1. Equipment for filling molds with colored mortars to obtain patterned tiles or the like, in machines for the manufacture of cement tiles and the like in which plural molds are moved cyclically through plural tile forming stations including a mold filling station: said equipment comprising, in combination a unit at the filling station mounting plural mold compartment defining partition units and operable to raise and lower said partition units and to move each partition unit horizontally between an operative position, in which it is aligned with a mold, and a washing position; a batch metering unit at the filling station; means mounting said batch metering unit and operable to raise and lower the same relative to a mold then at said filling station; an assembly of a plurality of small tanks on said batch metering unit operable to receive colored mortars fed thereto and stirred therein; respective discharge tubes extending through the bottoms of said small tanks in alignment with respective compartments of the partition unit then positioned in a mold at said filling station; respective metering cups slidable on said discharge tubes within said tanks; and means connected to said cups and operable to move said cups between a lower position, in which said cups are submerged in the mortars in said tanks, and an upper position, in which cups discharge the mortars therein into the associated discharge tubes for discharge into the respective compartments.

2. Equipment as claimed in claim 1, including means operable, when said cups are in said lower position, to cyclically move said cups relative to said small tanks to stir the mortars contained in said small tanks.

3. Equipment as claimed in claim 2, including, a first cylinder-piston system operable to lower said assembly of said small tanks and said cups onto a partition unit then inserted into a mold to be filled; a second cylinder-piston system combined and coaxial with said first cylinder-piston system operable to raise said cups relative to said assembly of said small tanks; and a crank and a connecting rod stirring system interposed between said second cylinder-piston system and said means connected to said cups to cyclically move said cups along the associated discharge tubes.

4. Equipment as claimed in claim 1, including a tray, operable to collect mortared droppings, insertable between a partition unit then in an operative position and said batch metering unit.

5. Equipment as claimed in claim 4, in which said tray is a multiple part tray.

6. Equipment as claimed in claim 1, including a collection cup at said washing position; a rotary spray unit in said collection cup; each partition unit, during washing, being moved into alignment with and lowered upon said collection cup; a covering plate adapted to be lowered into covering engagement with a partition unit at said washing position and onto said collection cup to protect against splashing from said collection cup; and means mounting said covering plate on said batch metering unit.

7. Equipment as claimed in claim 1, including probe means operable to control the level of mortars in said small tanks.

* * * * *